US007240817B2

(12) United States Patent
Higuchi

(10) Patent No.: US 7,240,817 B2
(45) Date of Patent: Jul. 10, 2007

(54) RESIDUAL STAPLE AMOUNT DETECTION DEVICE OF ELECTRIC STAPLER

(75) Inventor: Kazuo Higuchi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/520,124

(22) PCT Filed: Jun. 24, 2003

(86) PCT No.: PCT/JP03/08003

§ 371 (c)(1),
(2), (4) Date: Jan. 3, 2005

(87) PCT Pub. No.: WO2004/004981

PCT Pub. Date: Jan. 15, 2004

(65) Prior Publication Data

US 2005/0242149 A1 Nov. 3, 2005

(30) Foreign Application Priority Data

Jul. 4, 2002 (JP) ..... 2002-196135

(51) Int. Cl.
*B27F 7/11* (2006.01)
*B27F 7/28* (2006.01)

(52) U.S. Cl. ..... 227/2; 227/110; 227/120; 227/156

(58) Field of Classification Search ..... 227/2, 227/110, 120, 131, 156; 206/338; 271/110
See application file for complete search history.

(56) References Cited

U.S. PATENT DOCUMENTS 4,623,082 A * 11/1986 Kurosawa ..... 227/7
4,978,045 A * 12/1990 Murakami et al. ..... 227/1
5,269,451 A * 12/1993 Udagawa et al. ..... 227/120
5,269,503 A * 12/1993 Hiroi et al. ..... 270/58.09
5,535,937 A * 7/1996 Boiarski et al. ..... 227/175.3
5,700,003 A * 12/1997 Sung ..... 271/110
5,915,690 A * 6/1999 Surya ..... 271/265.01
5,992,724 A * 11/1999 Snyder ..... 227/120

FOREIGN PATENT DOCUMENTS

| | | |
|---|---|---|
| EP | 0 637 486 A1 | 2/1995 |
| EP | 0 861 708 A1 | 9/1998 |
| JP | U-03-033077 | 4/1991 |
| JP | U-04-054682 | 5/1992 |

* cited by examiner

*Primary Examiner*—Sameh H. Tawfik
*Assistant Examiner*—Nathaniel Chukwurah
(74) *Attorney, Agent, or Firm*—Morgan, Lewis & Bockius LLP

(57) ABSTRACT

In an electric stapler which is attachably and detachably provided with a staple cartridge 2 attached and detached to and from a magazine portion of a stapler main body 1 and in which in the staple cartridge 2, sheet-like staples a each constituted by connecting a number of staples in a straight form in a sheet-like shape are contained in a cartridge main body 2*a* in a stacked shape, and the sheet-like staples a are successively guided out to outside of an opening portion of a lower end portion of a front wall of the cartridge main body 2*a* from the sheet-like staple a at a lower end portion, an engaging plate 3 engaged with the sheet-like staple a at a topmost portion is arranged at an upper portion of the cartridge main body 2*a*, an inner side or an outer side of the cartridge main body 2*a* is provided with position detecting mechanism 9 for detecting a position of the engaging plate 3, and a remaining amount of the sheet-like staples a is detected based on detection of the position by the position detecting mechanism 9.

8 Claims, 10 Drawing Sheets

RESIDUAL STAPLE AMOUNT DETECTION DEVICE OF ELECTRIC STAPLER

TECHNICAL FIELD

The present invention relates to a staple remaining amount detecting apparatus in an electric stapler for detecting a remaining amount of a staple contained in a staple cartridge.

BACKGROUND ART

Generally, there is known an electric stapler in which a sheet staple constituted by connecting a number of staples in a straight form in a sheet-like shape is contained in a staple cartridge, the staple cartridge is inserted and detached into and from a path for mounting the cartridge formed at a magazine portion of a stapler main body, the staple cartridge is inserted to attach thereto and thereafter, both sides of a staple are successively folded to bend to strike out from a staple at a front portion of the sheet staple. According to such a system of an electric stapler, when a remaining amount of the sheet staple in the staple cartridge expires, the cartridge needs to be drawn out from the magazine portion to interchange by a new one thereof. For such a purpose, it is necessary to provide a staple detecting sensor for detecting the remaining amount of the sheet staple at inside of the staple cartridge in the staple main body, or interchange a refill at inside of the cartridge.

However, a remaining amount detecting sensor of a background art is provided at the stapler main body for detecting whether a sheet-like staple is present at inside of the staple cartridge as indicted in FIG. 2 of JP-Y-07-30282 by notation 41. Therefore, although presence or absence of the sheet-like staple can be detected, a degree of a remaining amount of to what degree the remaining amount is reduced cannot be known. Therefore, even when the remaining amount is small, a result of detection indicates as 'present' and when an electric stapler is provided to a copier or a printer, an operator is not informed of an accurate remaining amount.

DISCLOSURE OF THE INVENTION

It is a problem of the invention to provide a staple remaining amount detecting apparatus in an electric stapler resolving the above-described drawback and capable of informing a remaining amount of a staple at inside of a staple main body sufficiently accurately.

In order to resolve the above-described problem, a staple remaining amount detecting apparatus in an electric stapler according to the invention is characterized in that in the electric stapler attachably and detachably provided with a staple cartridge attached and detached to and from a magazine portion of a stapler main body for containing sheet-like staples each constituted by connecting a number of staples each in a straight form in a sheet-like shape in a stacked state, wherein the staples are guided out to outside of an opening portion of a lower end portion of a front wall of the cartridge main body successively from a lower end portion of the sheet-like staples, the staple remaining amount detecting apparatus is arranged with an engaging plate at an upper portion of the cartridge main body for being engaged with the sheet-like staple at a topmost portion, and provided with a position detecting mechanism on an inner side or an outer side of the cartridge main body for detecting a position of the engaging plate, wherein a remaining amount of the sheet-like staples is detected based on detection of the position by the position detecting mechanism.

Further, a staple remaining amount detecting apparatus in an electric stapler according to the invention is characterized in that in the electric stapler attachably and detachably provided with a staple cartridge attached and detached to and from a magazine portion of a stapler main body for containing a number of staples each in a straight form and wound in a roll-like shape, wherein the staples are successively guided out to outside of an opening portion of the cartridge main body from the staple at a front end portion, the staple remaining amount detecting apparatus is arranged with an engaging plate at an upper portion of the cartridge main body for being engaged with an upper end of the roll-like staple, and provided with a detecting mechanism for detecting a position of the engaging plate on an inner side or an outer side of the cartridge main body, wherein a remaining amount of the sheet-like staples is detected based on detection of the position by the detecting mechanism.

Further, it is preferable that the detecting mechanism is arranged with two rows of pairs of left and right conductors in an up and down direction, an output terminal is provided at an end portion of the conductor, an electrode provided at the engaging plate is slid while being brought into contact with each of the conductors, the position of the engaging plate is detected by a value of a voltage measured across the output terminals and the remaining amount of the sheet-like staple is detected based on detection of the position.

Further, the detecting mechanism may be constituted by detecting mechanism, alternately formed with a portion of transmitting and a portion of reflecting light in an up and down direction, an optical sensor provided at the engaging plate may be provided to the optical detecting mechanism to detect the position of the engaging plate by numbers of times of transmitting and cutting off light, and the remaining amount of the sheet-like staples may be detected based on detection of the position.

Figure 1:
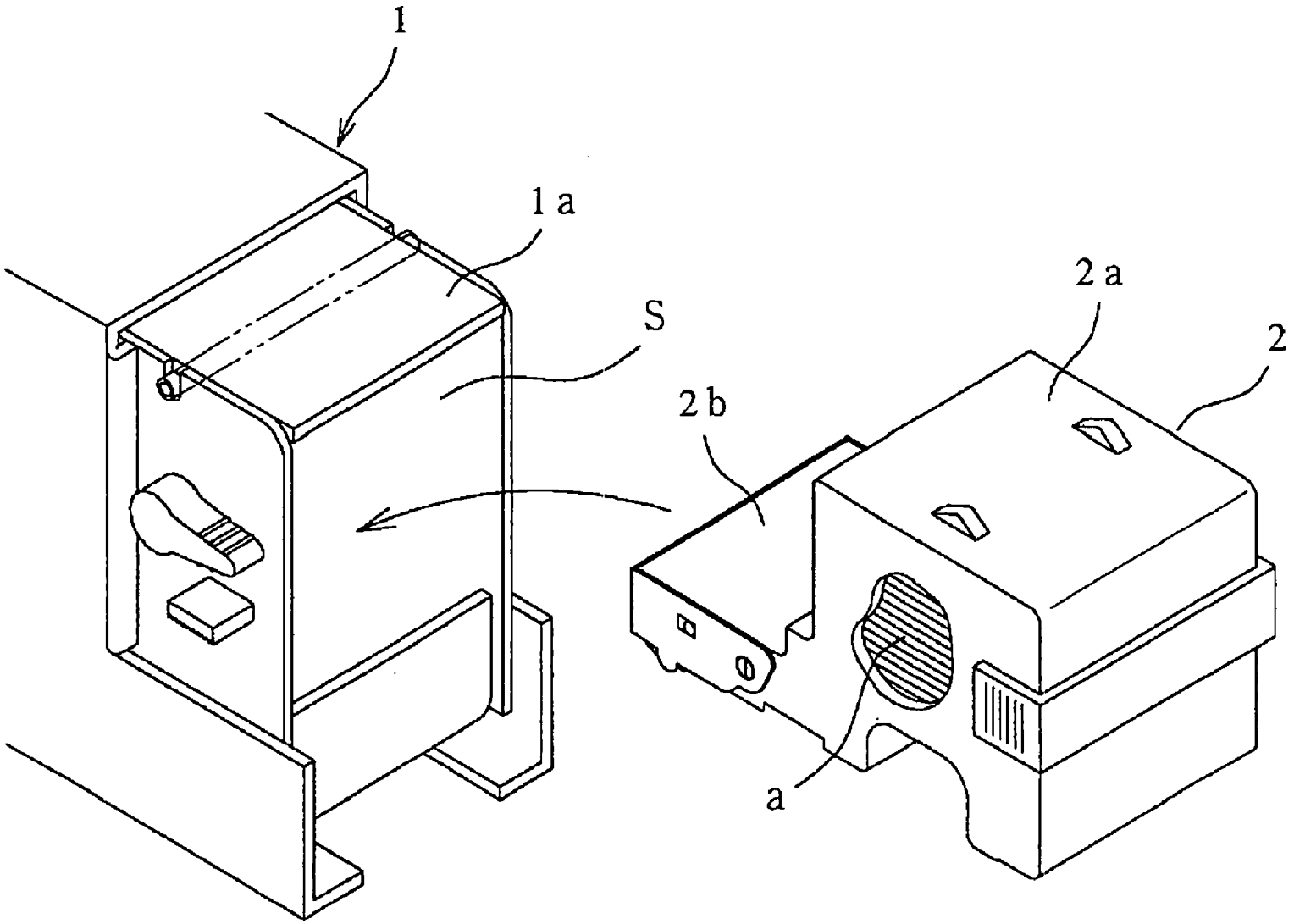
FIG. 1 is a perspective view of essential portions of a stapler main body and a staple cartridge.

Further, in notations in the drawings, numeral 1 designates a stapler main body, numeral 2 designates a staple cartridge, numeral 3 designates an engaging plate, and numeral 9 designates a position detecting mechanism.

BEST MODE FOR CARRYING OUT THE INVENTION

In FIG. 1, numeral 1 designates the electric stapler main body and numeral 2 designates the staple cartridge.

Figure 2:
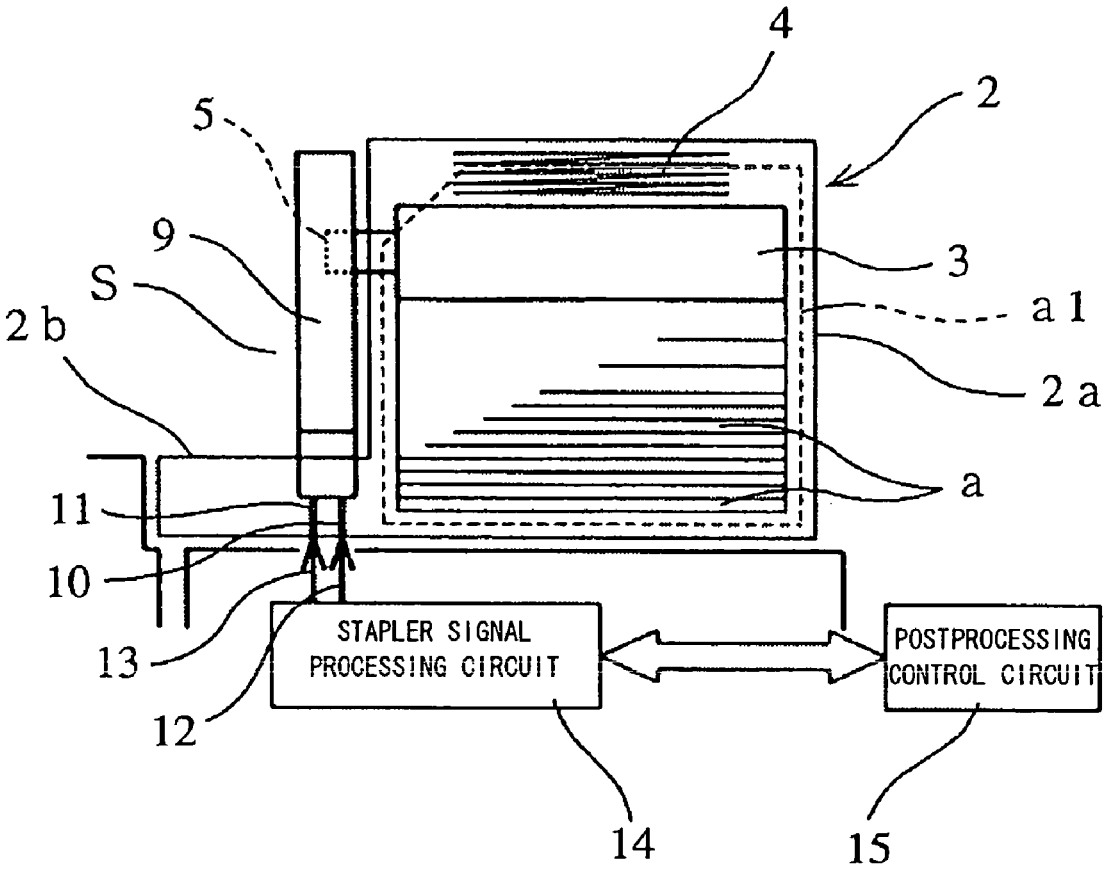
FIG. 2 is a side view showing an apparatus of detecting a remaining amount of a staple.

Sheet-like staples each constituted by connecting a number of staples in a straight form in a sheet-like shape are stacked in a plurality of layers to contain in a cartridge main body 2*a* of the staple cartridge 2. Further, as shown by FIG. 2, by a feed mechanism provided at the stapler main body 1, the sheet-like staples a are successively guided out to outside of a front guide 2*b* of the cartridge main body 2*a* from the sheet-like staple a at a lower end portion at inside of the cartridge main body 2*a*. Further, a magazine portion 1*a* of the stapler main body 1 is formed with a space s for mounting the cartridge 2. Further, the staple cartridge 2 is inserted to attach to the space s, the sheet staple a is fed frontwardly, both sides of the staple at the front end of the sheet staple a guided out from the front guide 2*b* are folded to bend and thereafter, penetrated through abound member (sheet) and finished to bind and thereafter, the sheet-like staple a is fed again frontwardly to prepare for successive binding. Thereafter, the operation is repeated and both sides of the staples are successively folded to bend to strike out from the staple a at the front portion. Further, since a mechanism of folding to bend to strike out both sides of a staple at a front end of a sheet-like staple is publicly known, an explanation thereof will be omitted here.

Figure 3:
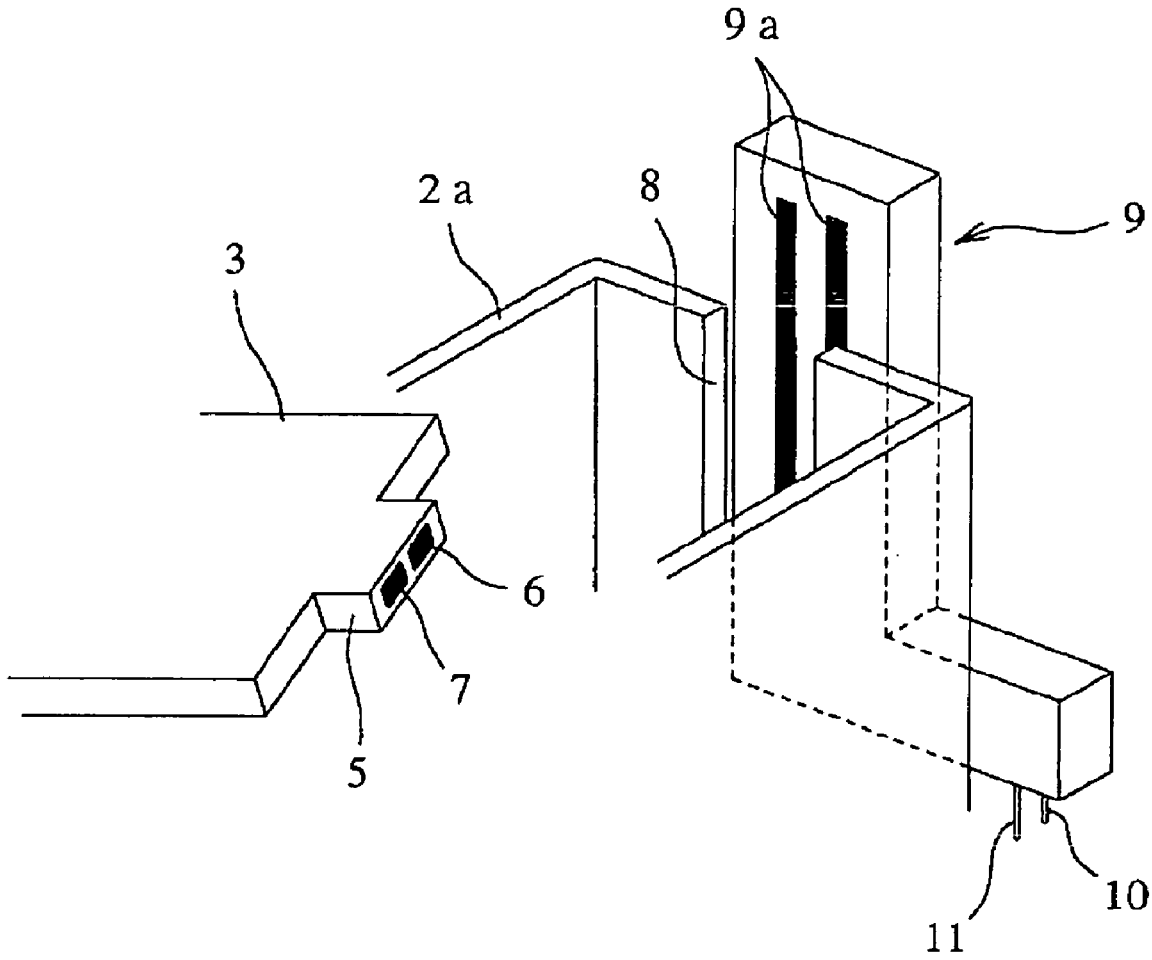
FIG. 3 is a perspective view of essential portions of an engaging plate and position detecting mechanism.
Figure 4:
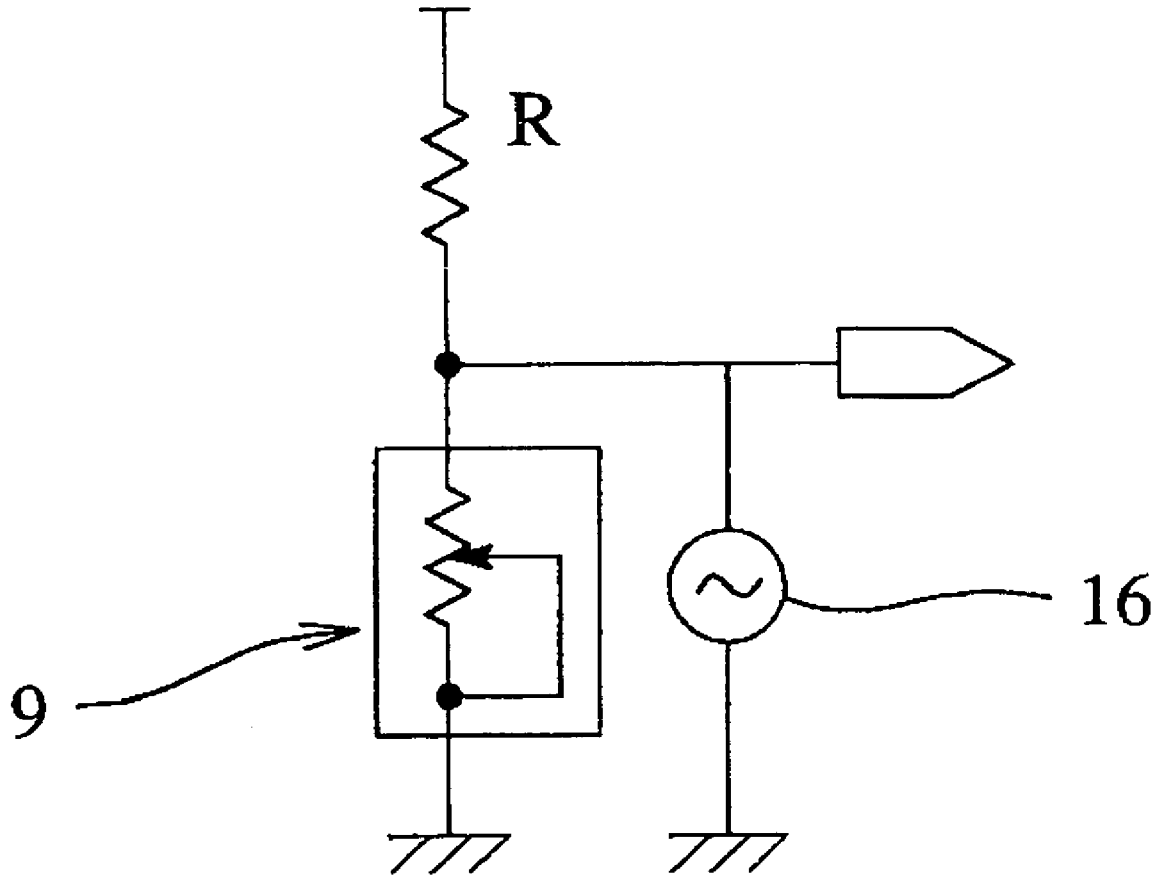
FIG. 4 is a block diagram of detecting a remaining amount by the position detecting mechanism.

The engaging plate 3 for engaging with the sheet-like staple a at a topmost portion is arranged at an upper portion of the cartridge main body 2*a*. The engaging plate 3 is always urged downwardly by a coil spring 4 to press the contained sheet-like staple a downwardly. Further, a projected portion 5 is formed at a center portion of a front end of the engaging plate 3 and the projected portion 5 is arranged with a pair of left and right electrodes 6, 7 (refer to FIG. 3). The electrodes 6, 7 are connected via a cord, not illustrated.

Next, an opening groove 8 continuous in an up and down direction is formed at a center of a front wall of the cartridge main body 2*a*. Further, the position detecting mechanism 9 of the engaging plate 3 is arranged at a position frontward from the opening groove 8. The position detecting mechanism 9 of the engaging plate 3 may be, for example, a conductor 9*a* shown in FIG. 3. Output terminals 10, 11 are provided at end portions of the conductors 9*a* and are brought into contact with contacts 12, 13 provided at the stapler main body 1. The contacts 12, 13 are connected to a signal processing circuit 14 and a postprocessing control circuit 15. Further, a voltage across the output terminals 10, 11 is measured by a voltage meter.

The projected portion 5 of the engaging plate 3 at inside of the cartridge main body 2*a* is projected from the opening groove 8 and the electrodes 6, 7 of the projected portion 5 are respectively brought into contact with the conductors 9*a*. Therefore, when the engaging plate 3 is moved in an up and down direction, the electrodes are slid in the up and down direction while being brought into contact with the conductors 9*a*. Therefore, when the voltage across the output terminals 10, 11 interposing the position detecting mechanism 9 is measured by a voltage meter 16, also the voltage is varied.

Figure 5A:
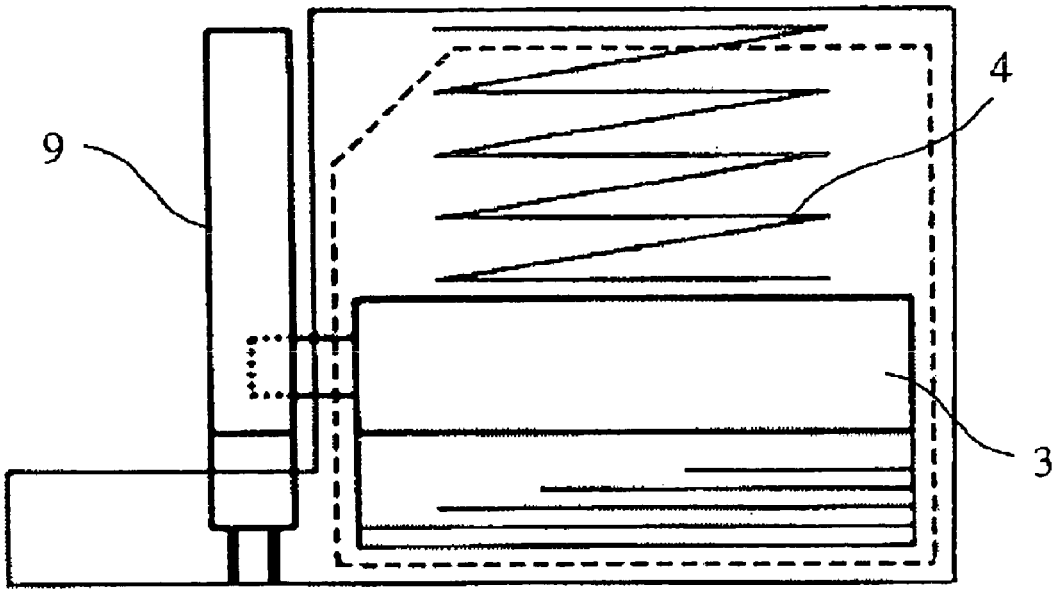
FIG. 5(*a*) and FIG. 5(*b*) are sectional views showing a state of moving down the engaging plate.
Figure 5B:
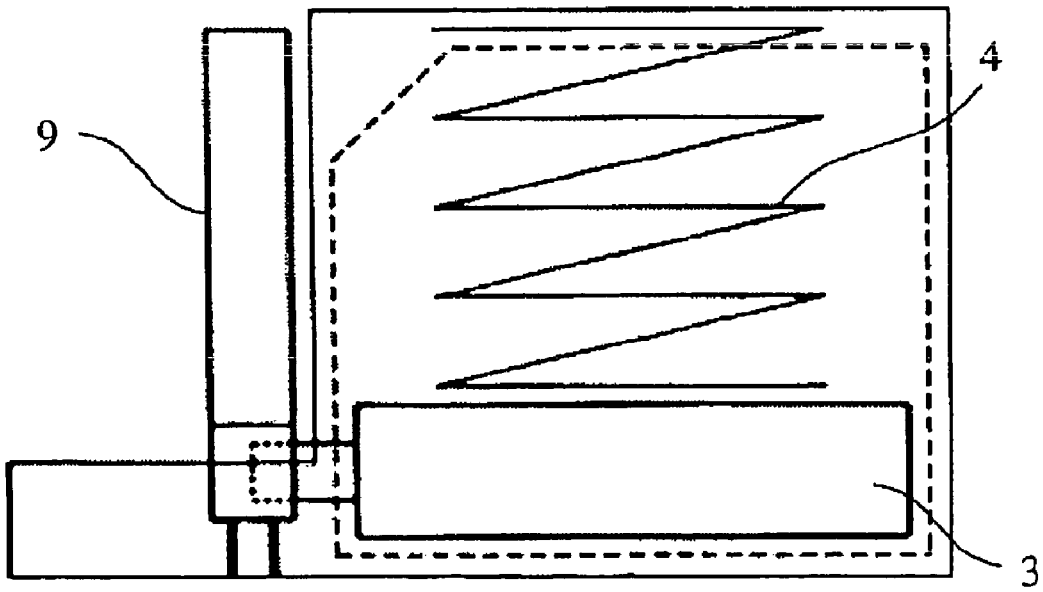

Explaining here of a mode of using the staple remaining amount detecting apparatus having the above-described constitution, first, after mounting the staple cartridge 2 to inside of the space s of the stapler main body 1, the staple sheet a at a lowermost layer is fed from an opening portion at a lower end portion of a front wall of the cartridge main body 2*a* to the guide portion 2*b*. Further, when the both sides of the staples are successively folded to bend to strike out from the staple at the front portion of the sheet staple a by driving a driver plate (not illustrated) provided at the stapler main body 1 in the up and down direction, the staples at inside of the staple cartridge 2 are consumed little by little. In accordance therewith, as shown by FIG. 5(*a*) and FIG. 5(*b*), also the engaging plate 3 is moved down little by little and therefore, also the electrodes 6, 7 of the engaging plate 3 are slid downwardly while being brought into contact with the conductors 9*a*. Therefore, also a resistance between the output terminals 10, 11 is linearly reduced, and also the voltage across the output terminals 10, 11 is lowered in accordance therewith. Therefore, the position of the engaging plate 3 can be detected by a value of the voltage measured across the output terminals 10, 11 and the remaining amount of the sheet-like staple a is finely detected based on detection of the position.

Figure 6:
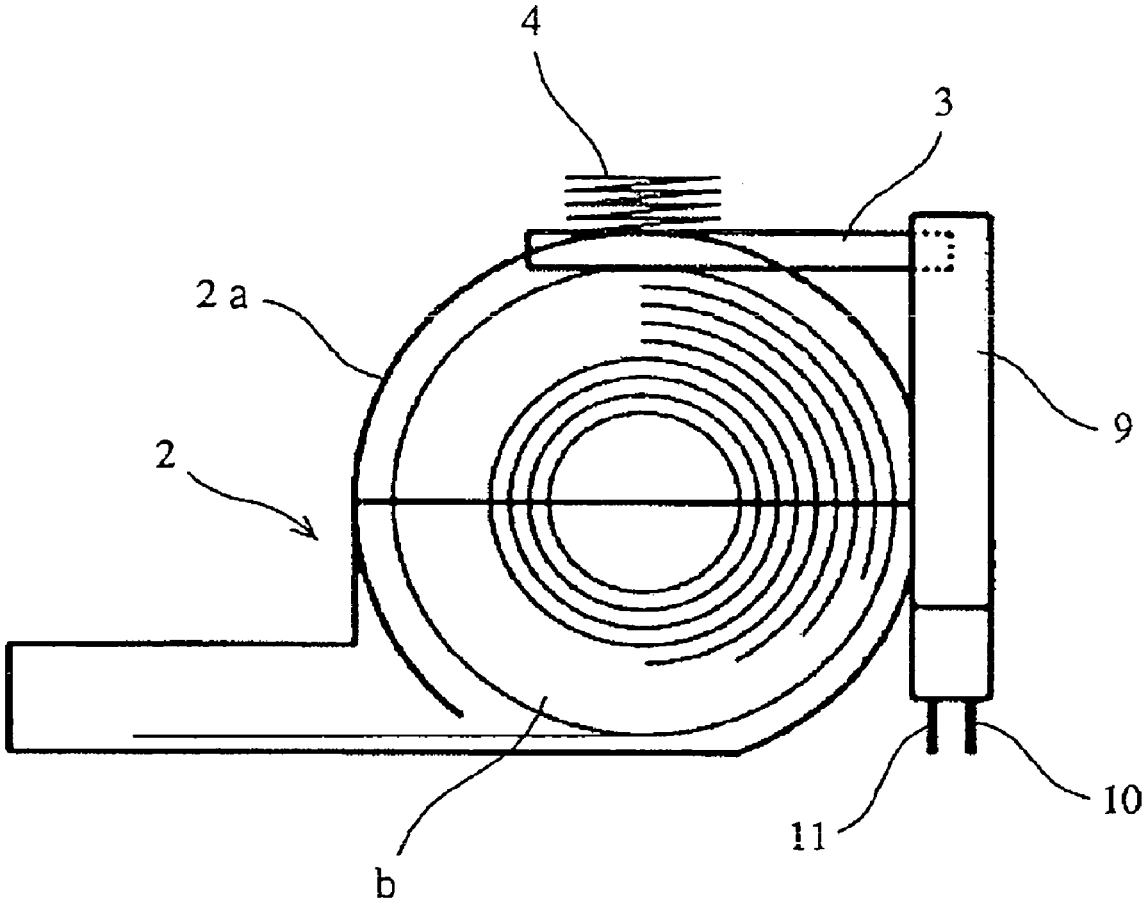
FIG. 6 is a simplified view of a section in an example of a roll staple.

Next, FIG. 6 shows other example of an electric stapler, also the electric stapler is attachably and detachably provided with the staple cartridge 2 attached and detached to and from the magazine portion of the stapler main body, and in the staple cartridge 2, a number of staples in a straight form are connected to be wound in a roll-like shape to contain in the cartridge main body 2*a* and are guided out to outside of the opening portion of the cartridge main body 2*a* successively from the staple at the front end portion.

Also in this case, the engaging plate 3 engaged with an upper end of the roll-like staple b is arranged at an upper portion of the cartridge main body 2*a*, inside or outside of the cartridge main body 2*a* is arranged with the conductors 9*a* provided with the output terminals 10, 11 at the end portion as the position detecting mechanism 9 of the engaging plate 3 similar to the above-described, the output terminals 10, 11 are provided at the end portions of the conductors 9*a*, and the stapler main body 1 is connected with the signal processing circuit and the postprocessing control circuit the same as the above-described. Further, the voltage across the output terminals 10, 11 is measured by the voltage meter.

Also in the case of the example, when the roll-like staple b in the staple cartridge 2 is consumed little by little, also the engaging plate 3 is lowered little by little, also the electrodes of the engaging plate 3 are slid downwardly while being brought into contact with the conductors 9*a* and therefore, also the voltage across the output terminals 10, 11 is lowered in accordance therewith. Therefore, the position of the engaging plate 3 can be detected by the value of the voltage measured across the output terminals 10, 11 and the remaining amount of the staple can finely be detected based on detection of the position.

Figure 7:
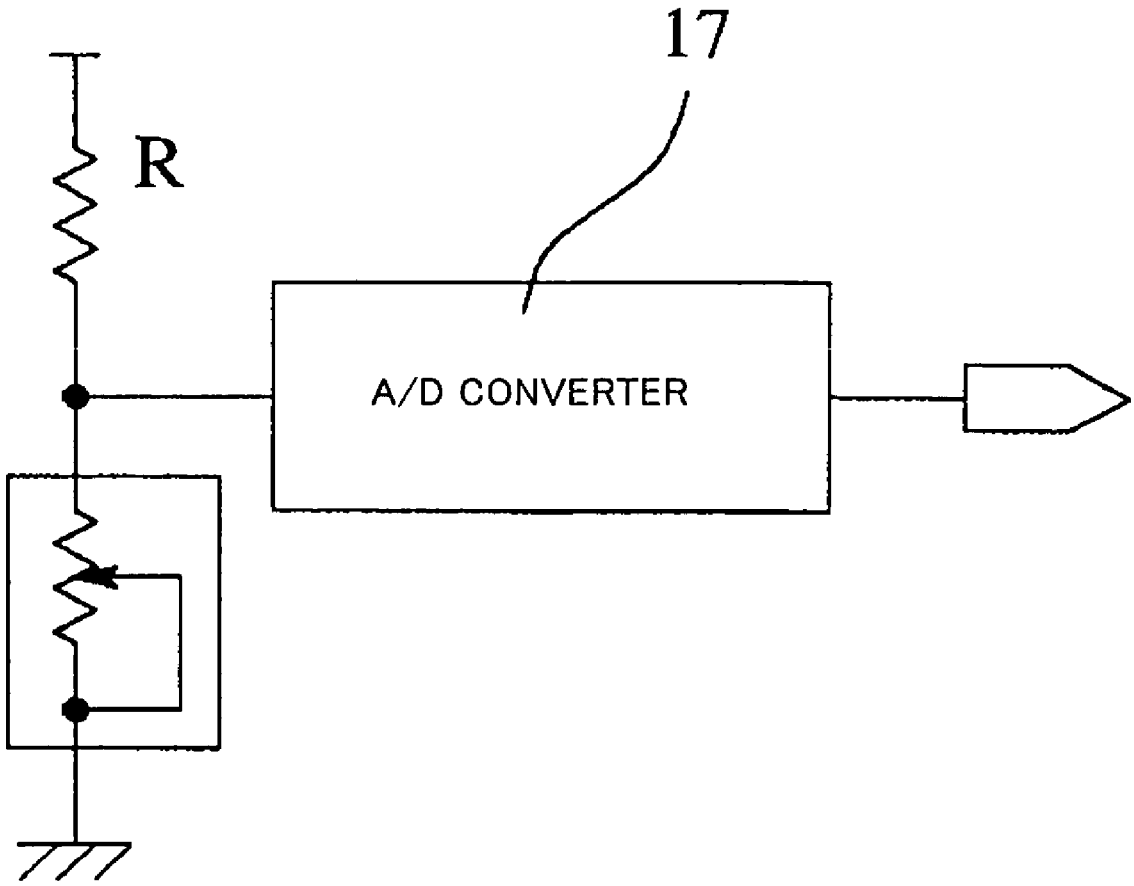
FIG. 7 is a block diagram of detecting a remaining amount by position detecting mechanism.

Further, in the above-described two examples, as shown by FIG. 7, by arranging an analog/digital converter 17 in place of the voltage meter, the remaining amount of the staple can be grasped as a digital value.

Further, the sheet-like staple a is not limited to an example of being directly filled in the cartridge main body 2*a*. The sheet-like staple a in a state of being packed in a paper pack or the like shown by a dotted line a1 in FIG. 2 in a stacked state may be supplied as a refill.

Figure 8:
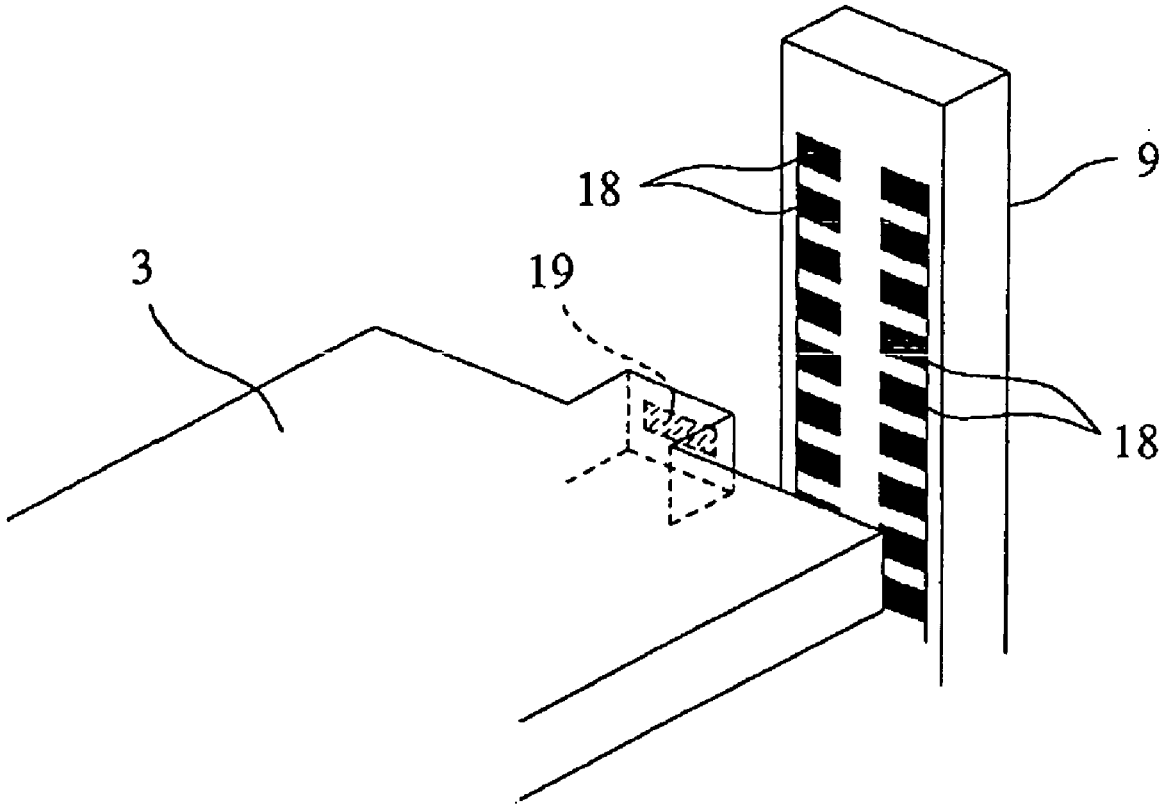
FIG. 8 is a perspective view of essential portions of an engaging plate and position detecting mechanism.

Further, detection of the position may not be carried out by the above-described variable resistor. For example, as shown by FIG. 8, a conductor 19 is formed at a front face of the engaging plate 3 and the electrodes 18 are formed at every other layer as the position detecting mechanism 9. Therefore, while moving down the engaging plate 3, when the position detecting mechanism 9 is brought into contact with the electrode 18, electricity is conducted and when the position detecting mechanism 9 are separated from the electrode 18, electricity is cut off. Further, a side of the stapler main body 1 is provided with a control apparatus for measuring numbers of times of conducting electricity and cutting off electricity to and from the electrode 18 and determining the position of the engaging plate 3 by the numbers of times. According thereto, although a number of times of electricity conduction is null when the engaging plate 3 is disposed at a topmost portion, while moving down the engaging plate 3, the number of times of electricity conduction is increased and therefore, the position of the engaging plate 3 can be detected by the number of times of electricity conduction.

Figure 9:
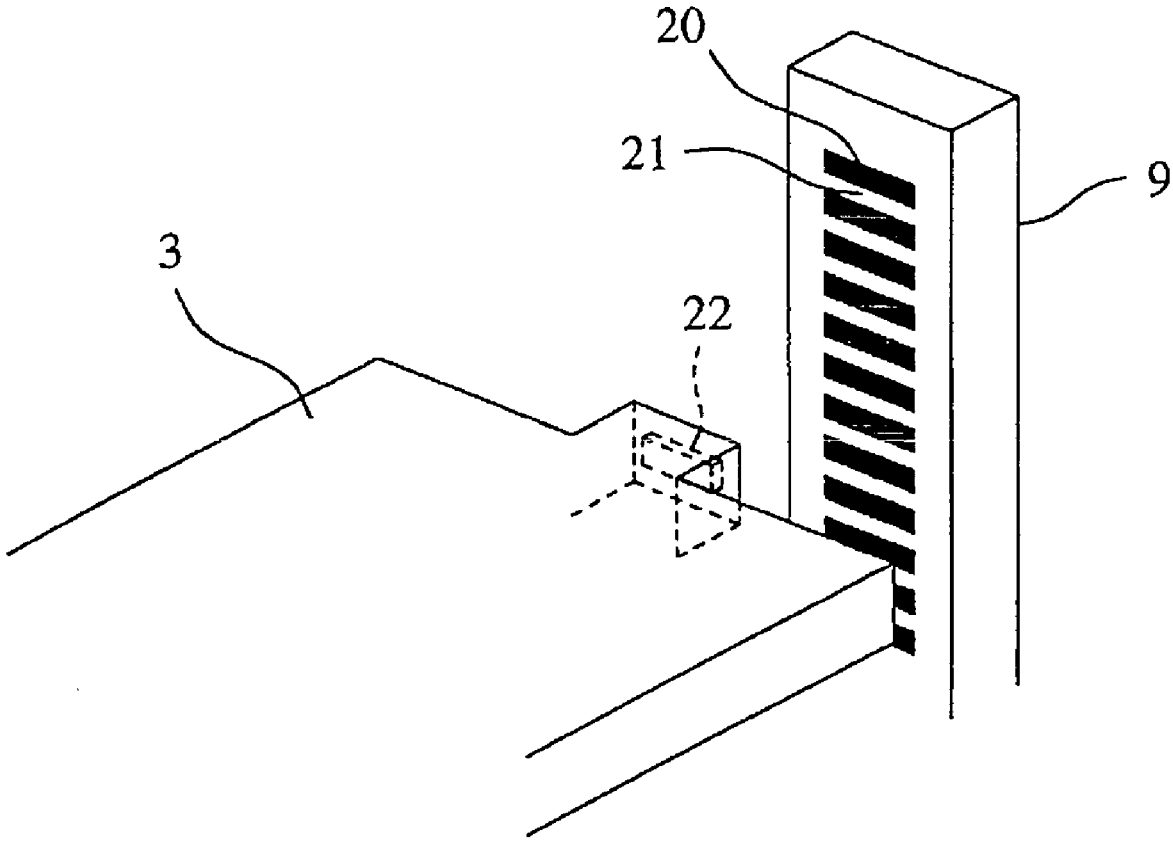
FIG. 9 is an explanatory view of other example of a staple remaining amount detecting apparatus.

Next, the position detecting mechanism 9 is not necessarily limited to a mechanism for electrically detecting the position. For example, as shown by FIG. 9, the position detecting mechanism 9 may be constructed by a constitution in which portions 20 for transmitting light and portions 21 for reflecting light are alternately formed in an up and down direction and an optical sensor 22 is provided at the front portion of the engaging plate 3. When the optical sensor 22 respectively counts a time point of passing the light transmitting portion 20 and a time point of passing the reflecting portion 21 while moving down the engaging plate 3, the position of the engaging plate 3 can be detected by the numbers of times of measuring the numbers of times of transmitting and cutting off light and the remaining amount of the sheet-like staple a can be detected based on detection of the position.

Figure 10:
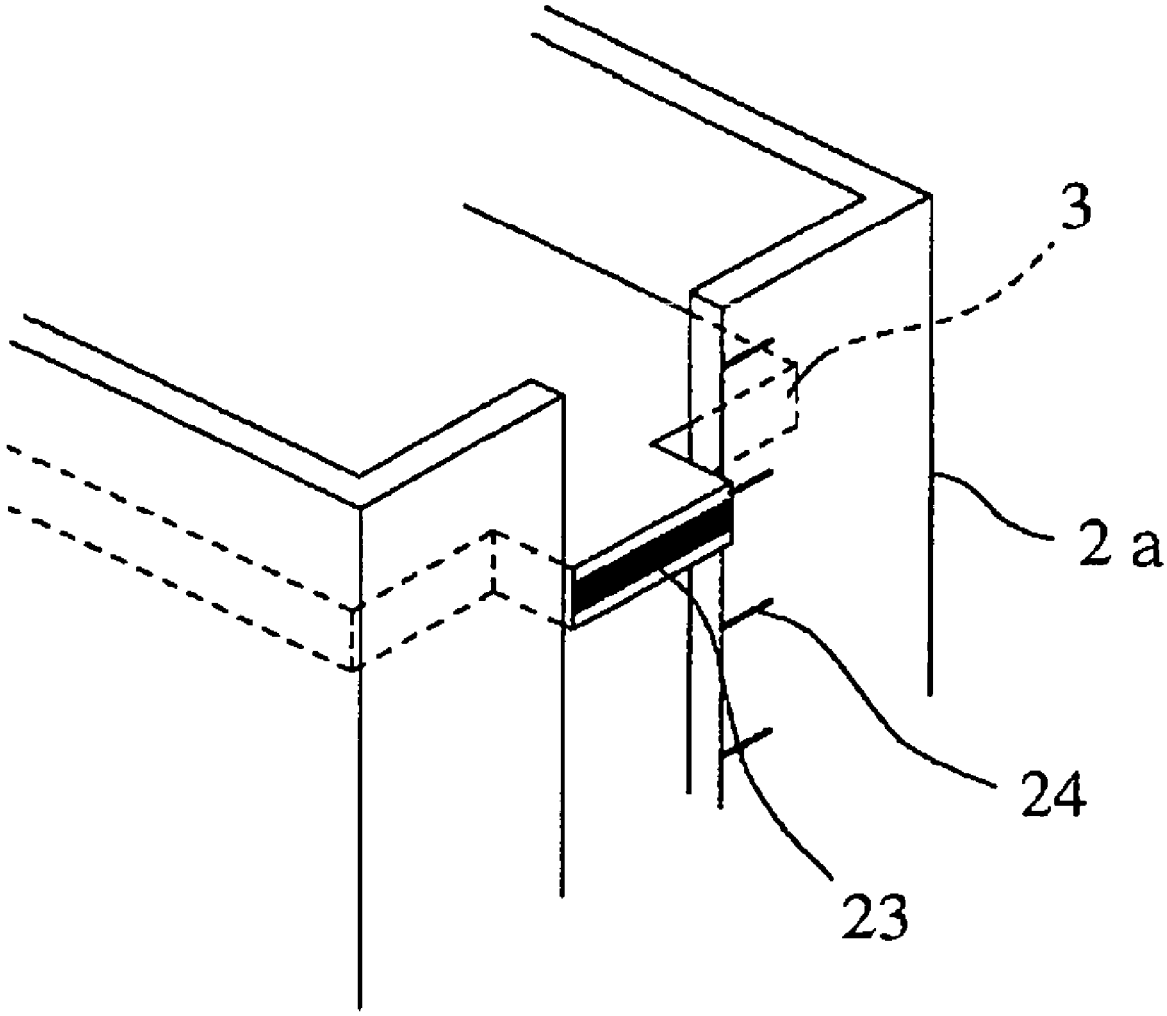
FIG. 10 is an explanatory view of still other example of a staple remaining amount detecting apparatus.

Further, the position detecting mechanism is not limited to the example of being provided on an outer side of the cartridge main body. The position detecting mechanism may be arranged at an inner side thereof. Further, the 'inner side' and the 'outer side' are not limited to be separate from the cartridge main body. For example, as shown by FIG. 10, a graduation 24 may be formed on an outer side of an edge of the opening groove of the cartridge main body 2*a* as position detecting mechanism for detecting a position of a reference line 23 of the engaging plate 3 and the remaining amount of the sheet-like staple may be detected based on detection of the position of the engaging plate 3 by the position detecting mechanism 24. In this case, the graduation 24 is detected by directly confirming the graduation 24 by the eyes. Similarly, (although not illustrated) the cartridge main body may be made to be transparent, an outer side face thereof may be formed with a graduation as position detecting mechanism for detecting the position of the engaging plate, and the remaining amount of the sheet-like staple may be detected based on detection of the position of the engaging plate by the position detecting mechanism.

Further, although the above-described respective examples relate to the case of successively moving down the staple from the upper end, there is also a case of arranging the staple cartridge downwardly, in this case, the position of the engaging plate is moved upwardly while consuming the staples and therefore, the measurement may be carried out in accordance with a state of increasing or reducing the staples.

INDUSTRIAL APPLICABILITY

As described above, the upper portion of the cartridge main body 2*a* is arranged with the engaging plate 3 engaged with the staple at the topmost portion formed in the sheet-like shape or the roll-like shape, the inner side or the outer side of the cartridge main body 2*a* is provided with the position detecting mechanism 9 of the engaging plate 3, the remaining amount of the staple is detected based on detection of the position of the position detecting mechanism 9 and therefore, the position of the engaging plate 3 is changed from time to time in accordance with consumption of the staples and therefore, the remaining amount of the staples can accurately be grasped.

The invention claimed is:

1. A staple remaining amount detecting apparatus in an electric stapler, used in an electric stapler comprising a staple cartridge provided attachably and detachably to and from a magazine portion of a stapler main body for containing sheet-like staples each constituted by connecting a number of staples in a straight form in a sheet-like shape in a stacked state, wherein the staples are guided out to outside of an opening portion of a lower end portion of a front wall of the cartridge main body successively from a lower end portion of the sheet-like staples, comprising:

an engaging plate arranged at an upper portion of the cartridge main body and engaged with the sheet-like staple at a topmost portion; and a position detecting mechanism for detecting a position of the engaging plate, wherein a remaining amount of the sheet-like staples is detected based on the detection of the position of the engaging plate by the position detecting mechanism, wherein the position detecting mechanism comprises a plurality of conductors and an output terminal provided at each of the conductors, wherein the engaging plate is provided with an electrode made to be movable along the conductors while being brought into contact with each of the conductors, and wherein the position of the engaging plate is detected based on a value of a voltage measured across the output terminals, and the remaining amount of the sheet-like staples is detected based on the detection of the position of the engaging plate.

2. A staple remaining amount detecting apparatus in an electric stapler, used in an electric stapler comprising a staple cartridge provided attachably and detachably to and from a magazine portion of a stapler main body for containing a number of staples each in a straight form and wound in a roll-like shape, wherein the staples are successively guided out to outside of an opening portion of the cartridge main body from the staple at a front end portion, comprising:

an engaging plate arranged at an upper portion of the cartridge main body and engaged with an upper end of the roll-like staple; and a position detecting mechanism for detecting a position of the engaging plate, wherein a remaining amount of the roll-like staples is detected based on the detection of the-position of the engaging plate by the position detecting mechanism, wherein the position detecting mechanism comprises a plurality of conductors and an output terminal provided at each of the conductors, wherein the engaging plate is provided with an electrode made to be movable along the conductors while being brought into contact with each of the conductors, and wherein the position of the engaging plate is detected based on a value of a voltage measured across the output terminals, and the remaining amount of the roll-like staples is detected based on the detection of the position of the engaging plate.

3. A staple remaining amount detecting apparatus in an electric stapler, used in an electric stapler comprising a staple cartridge provided attachably and detachably to and from a magazine portion of a stapler main body for containing sheet-like staples each constituted by connecting a number of staples in a straight form in a sheet-like shape in a stacked state, wherein the staples are guided out to outside of an opening portion of a lower end portion of a front wall of the cartridge main body successively from a lower end portion of the sheet-like staples, comprising:

an engaging plate arranged at an upper portion of the cartridge main body and engaged with the sheet-like staple at a topmost portion; and a position detecting mechanism for detecting a position of the engaging plate, wherein a remaining amount of the sheet-like staples is detected based on the detection of the position of the engaging plate by the position detecting mechanism, wherein the position detecting mechanism provides an electrical signal based on the detection of the position of a projected portion of the engaging plate, wherein the position detecting mechanism comprises a plurality of conductors and an output terminal provided at each of the conductors, wherein the engaging plate is provided with an electrode made to be movable along the conductors while being brought into contact with each of the conductors, and wherein the position of the engaging plate is detected based on a value of a voltage measured across the output terminals, and the remaining amount of the sheet-like staples is detected based on the detection of the position of the engaging plate.

4. The staple remaining amount detecting apparatus in an electric stapler according to claim 3, wherein the electrical signal is a voltage that is variable based on the position of the engaging plate.

5. The staple remaining amount detecting apparatus in an electric stapler according to claim 3, wherein the position detecting mechanism detects the position of the engaging plate by counting electrical signals.

6. A staple remaining amount detecting apparatus in an electric stapler, used in an electric stapler comprising a staple cartridge provided attachably and detachably to and from a magazine portion of a stapler main body for containing a number of staples each in a straight form and wound in a roll-like shape, wherein the staples are successively guided out to outside of an opening portion of the cartridge main body from the staple at a front end portion, comprising:

an engaging plate arranged at an upper portion of the cartridge main body and engaged with an upper end of the roll-like staple; and a position detecting mechanism for detecting a position of the engaging plate, wherein a remaining amount of the roll-like staples is detected based on the detection of the-position of the engaging plate by the position detecting mechanism, wherein the position detecting mechanism provides an electrical signal based on the detection of the position of a projected portion of the engaging plate, wherein the position detecting mechanism comprises a plurality of conductors and an output terminal provided at each of the conductors, wherein the engaging plate is provided with an electrode made to be movable along the conductors while being brought into contact with each of the conductors, and wherein the position of the engaging plate is detected based on a value of a voltage measured across the output terminals, and the remaining amount of the roll-like staples is detected based on the detection of the position of the engaging plate.

7. The staple remaining amount detecting apparatus in an electric stapler according to claim 6, wherein the electrical signal is a voltage that is variable based on the position of the engaging plate.

8. The staple remaining amount detecting apparatus in an electric stapler according to claim 6, wherein the position detecting mechanism detects the position of the engaging plate by counting electrical signals.

* * * * *